United States Patent [19]

Gaisch et al.

[11] 4,407,307

[45] Oct. 4, 1983

[54] PROCESS FOR THE PREPARATION OF TOBACCO AND TOBACCO PREPARED ACCORDING TO THIS PROCESS

[75] Inventors: Helmut Gaisch, Cormondrèche; Patrick D. L. Ghiste, Boudry; Dieter Schulthess, Neuchâtel, all of Switzerland

[73] Assignee: Fabriques de Tabac Reunies, S.A., Neuchatel, Switzerland

[21] Appl. No.: 337,807

[22] Filed: Jan. 7, 1982

[30] Foreign Application Priority Data

Jan. 13, 1981 [DE] Fed. Rep. of Germany ..... 3100715

[51] Int. Cl.[3] ..... A24B 3/18; A24B 15/26

[52] U.S. Cl. ..... 131/308; 131/297

[58] Field of Search ..... 131/297, 308, 298, 290, 131/300

[56] References Cited

U.S. PATENT DOCUMENTS

| | | | |
|---|---|---|---|
| 3,132,651 | 5/1964 | Kiefer | 131/308 |
| 4,135,521 | 1/1979 | Malan et al. | 131/308 |
| 4,308,877 | 1/1982 | Mattina | 131/308 |

*Primary Examiner*—V. Millin

*Attorney, Agent, or Firm*—Arthur I. Palmer, Jr.; D. Anthony Gregory; George E. Inskeep

[57] ABSTRACT

For the preparation of tobacco, the insoluble proteins are initially made soluble by enzymatic treatment, dissolved and then eliminated in the solution by metabolic assimilation. The remaining solution components are then returned to the tobacco.

7 Claims, No Drawings

PROCESS FOR THE PREPARATION OF TOBACCO AND TOBACCO PREPARED ACCORDING TO THIS PROCESS

The invention relates to a process for the preparation of tobacco into which initially insoluble protein components and protein subunits are decomposed into soluble protein fragments by enzymatic treatment and then the soluble components are dissolved in water and the solution obtained is separated from the treated tobacco and tobacco prepared by this process.

In a process known from U.S. Pat. No. 3,132,651 in which the ageing process is accelerated by enzymes and nicotine is removed, protein components are extracted from the tobacco together with the soluble components thereof. In this way, a prepared tobacco is obtained, which admittedly does not contain the then undesired protein components, but has also lost many of its soluble components and consequently constitutes a hardly enjoyable tobacco product.

The problem of the present invention is to provide a processed tobacco, whose content of protein components and their subunits is considerably reduced, but whose content of other soluble components is as far as possible not reduced.

The process of the invention is characterized in that the protein components, protein subunits and low molecular weight nitrogen compounds are eliminated from the separated solution by metabolic assimilation brought about by microorganisms and subsequent separation of the biomass and that pretreated tobacco is added to the solution components remaining in the residual solution.

As a result of the metabolic assimilation, the undesired protein components and their subunits, as well as low molecular weight nitrogen compounds such as amines, ammonia, nitrate and, if present, nitrite pass into the biomass, whereas the remaining soluble components which are to be dissolved out of the tobacco are essentially left behind in the residual solution and can be added again to the tobacco, optionally after evaporating the residual solution.

Most protein components are soluble in green tobacco, so that they could be dissolved out without enzymatic treatment. However, this is not recommended because then said protein components are no longer available during curing, when they fulfil an important function. However, during curing a large proportion of the originally soluble protein components are denatured to insoluble green components. However, as a result of the enzymatic pretreatment of the process according to the invention said components can largely be made soluble again.

The enzymatic treatment appropriately takes place in a mixture of comminuted tobacco and water in a weight ratio of 1:3 to 1:12 and preferably 1:5. It is possible to use comminuted, cured, green tobacco or tobacco waste comminuted for processing. If the tobacco is used in pulverized form, a tobacco to water weight ratio of 1:3 to 1:5 is adequate. Enzymatic treatment in a suspension is advantageous because, as a result, an intense action of the enzyme on the protein components and subunits is assisted. However, if whole tobacco leaves or strips, i.e. deribbed tobacco leaves are used, a tobacco to water weight ratio of 1:8 to 1:12 and preferably 1:10 is necessary. The optimum conditions during enzymatic treatment with respect to the tobacco-water ratio, the pH value, the solution and the treatment temperature are dependent on the particular enzyme used, and can, if necessary, be determined by trial and error. The optimum treatment temperature for most enzymes is in the range 30° to 70° C. Many enzymes, including proteases have an optimum at 37° C. However, there are also proteases which are most active at much higher temperatures, e.g. detergent enzymes. The optimum pH value for many enzymes is in the range pH 7.0 to pH 7.5. However, an exception is formed by acid proteases, for example pepsin, whose pH optimum is between 1.5 and 4. The optimum pH value is preferably adjusted with 1 N KOH (1 normal potassium hydroxide solution), or 85% $H_3PO_4$ (phosphoric acid).

Preferably, the enzyme is used with a concentration selected sufficiently high that with the optimum treatment temperature in the range 30° to 70° C., optimum pH value and with constant stirring of the active enzyme used before it has lost 9/10 of its original activity the content of insoluble proteins and protein subunits in the tobacco is reduced to 20 to 40% and preferably 33% of the initial value.

It is appropriate to use a higher enzyme concentration if the sought protein reduction is not obtained by the indicated enzyme decomposition. If he sought protein reduction is reached before the indicated enzyme decomposition has taken place this indicates that the enzyme concentration has been made unnecessarily high and it can be reduced for subsequent charges. Thus, the most advantageous concentration for the enzyme used can be determined by trial and error. With an enzyme concentration determined as optimum in this way, the protein reduction can be extended less far, by prematurely breaking off the treatment. However, in this case the enzyme has not been completely used.

Enzymes with a proteolytic activity can be used, most bacteriologically and mycologically formed proteolytic enzymes being suitable as well as proteases from plants (e.g. papain). However, pure enzymes or enzyme mixtures can be used. A selection of suitable enzymes is given in Table 1 at the end of the description.

The metabolic assimilation in the separated solution is appropriately sterilized and then inocculated with a culture of microorganisms having the capacity to assimilate protein and protein sub-units, mainly amino acids and brought into the exponential growth phase thereof. Accompanied by the addition of sugar, the solution is kept under favourable living conditions for the said culture until the dissolved protein fragments and other low molecular weight nitrogen compounds have been at least 95% consumed as builders for the cells own protein for the microorganisms. Metabolic assimilation is then broken off by separating the biomass.

Sterilization and use in the exponential growth phase ensure that the selected culture is selectively active and is not contaminated by other microorganisms. It is ensured that only the desired reactions take place by breaking off the metabolic assimilation.

Aroma substances which are desired in the tobacco smoke form during the burning of the tobacco as a result of the decomposition of certain amadori compounds, which are in turn formed during the thermal reaction of certain amino acids with sugar. In certain cases, these amino acids are not present in adequate quantities for optimum aroma formation in the treated tobacco mixed with the residual solution. The contents could be topped up by adding such amino acids or amadori compounds, but this is disadvantageous from the cost standpoint and also from the standpoint that as far as possible no foreign substances should be added to the tobacco.

The invention therefore proposes the destructive hydrolyzing of the proteins contained in the separated biomass, the hydrolysis conditions being selected in such a way that those amino acids such as e.g. tryptophan which with reducing sugar and heating (Maillard reaction) cannot be converted into those amadori compounds which liberate tobacco aromas on thermal decomposition are selectively destroyed and that then the other amino acids are converted with reducing sugar into amador compounds such as e.g. aspartic acid, leucine, arginine, threonine, glutamine, glycine and valine and that the amadori compounds obtained in this way are added to the pretreated tobacco.

As a result of the metabolic assimilation of the microorganisms, there may, in certain circumstances, be larger quantities of such amino acids in the biomass than were present in the separated solution, so that without any particular effort there is a desirable gain of these amino acids which are important for aroma formation.

The addition of the solution components left behind in the residual solution and/or the amino acid separated from the biomass and/or the amadori compounds obtained therefrom to the pretreated tobacco preferably takes place in finely divided form in aqueous medium with a subsequent drying of the enriched, pretreated tobacco.

When here and hereinafter reference is made to the fact that substances are extracted from the tobacco and other substances are added thereto, this need not necessarily refer to the same tobacco charge. Thus, substances can be extracted from a first tobacco charge and the substances to be added again can be added to the second tobacco charge which had previously undergone such an extraction.

The process of the invention makes it possible to obtain a prepared tobacco suitable as a smoking product, which is characterized by a protein content of 2 to 10, preferably 3 dry weight percent and an amadori compound content of 0.1 to 10 and preferably 5 dry weight %. The amadori compounds are those which liberate tobacco aromas during thermal decomposition.

Cigarettes made from such a tobacco gave the analytical values given in Table 2 at the end of the description.

The invention is illustrated hereinafter by means of a number of examples.

EXAMPLE 1

3.75 g of the enzyme protease EC3.4.24.4 with an enzyme activity of 1.0 enzyme unit/mg were dissolved in 10 liters of water. An enzyme unit is the activity hydrolyzed by casein at pH 7.5 and at 37° C. so that 1 micromol of tyrosine is liberated per minute. 1 kg of the tobacco mixture (American Blend) to be prepared was suspended in the form of strips, i.e. deribbed leaves in said 10 liters of enzyme solution. These slurries were left to stand for 6 hours at 37° C., accompanied by occasional stirring. The aqueous phase was then separated from the strips and the latter were then washed twice with in each case 2.5 liters of water at 80° C. and then pressed out. The aqueous phase, the washing water and the liquid obtained on pressing out were combined with the solution, giving a total solution of 12 liters.

The pretreated tobacco, i.e. the pressed-out strips were cured in a hot air flow to a residual moisture content of 18% and stored. The tobacco mixture to be prepared, the solution and the pretreated tobacco were analysed, giving the analytical values of Table 3.

Table 3 shows that 58 dry weight % of the proteins present in the tobacco mixture to be prepared have been decomposed and the decomposition products have been transferred into the solution.

The following additives were added to the 12 liters of solution:

glucose (40 g per 1.086 gm $NO_3$—N+$NH_2$/$NH_3$—N) . . . 506 g $KH_2PO_4$(potassium hydrogen phosphate) (0.2% per extract quantity) . . . 24 g.

The thus prepared solution was sterilized under pressure in an autoclave at 105° C. and then pressure-relieved. It was then cooled to 30° C. and transferred into a 20 liter fermenter. The prepared solution at 20° C. was inoculated with 600 ml of a culture of Candida utilis NCYC 707 in its exponential growth phase. The inoculated solution was left in the fermenter for 8 hours accompanied by venting and continuous stirring. The pH value was initially stabilized with KOH (potassium hydroxide) and then with citric acid to pH 5.5. The proteins, amino acids, nitrates and nitrites were decomposed by metabolic assimilation. At the end of 8 hours, the biomass was centrifuged. 2.25 liters of biomass with a solids content of 16%, corresponding to 360 g of anhydrous biomass were obtained.

The residual solution obtained as a result of centrifuging contained the tobacco alkaloids in the original concentration, as well as traces of soluble nitrogen compounds. The total residual solution volume was 9.75 liters, which was stored at 20° C. for subsequent reuse.

The filtered biomass was refluxed for 15 hours in a round-bottom flask with 1 liter of 6 N hydrochloric acid. The biomass decomposed and the proteins were destructively hydrolyzed, the amino acid tryptophan being destroyed to such an extent that after hydrolysis it could no longer be analytically detected.

The biomass residues were separated from the hydrolyzate by filtering and the filtrate was dried by distillation. At this point the excess hydrochloric acid escaped. The dry residue, largely consisting of amino acids, was mixed with 100 ml of water and filtered from the insoluble residue. An amino acid mixture with a water content of approximately 50% was obtained.

This amino acid mixture was adjusted to pH 7 with $NH_4OH$ (ammonium hydroxide), mixed with 100 g of glucose and refluxed for 2 hours in a round-bottomed flask, which turned brown and amadori compounds were formed. The still hot flask content was washed out with the previously obtained residual solution, so that the soluble amadori compounds passed into the residual solution.

The thus obtained residual solution enriched with amadori compounds was sprayed onto the pretreated tobacco, i.e. the pressed-out strips in a rotary flavour drum, the excess water being evaporated off during spraying by blowing on hot air.

The thus obtained, prepared tobacco had or developed its full original aroma and contained alkaloid nitrogen, i.e. nicotine in the original concentration. However, the content of protein nitrogen was reduced by 58% and the content of amine, ammonia and nitrate nitrogen by 90% compared with the original contents in the tobacco used.

EXAMPLES 2 TO 22

These examples differ from example 1 only on the basis of the facts given in Table 4.

Candida utilis NCYC 707 was used as the microorganisms in examples 1 to 22. Table 5 gives other microorganisms which are able to assimilate proteins and protein subunits and which can be used in place of Candida utilis NCYC 707.

TABLE 1

| Choice of suitable enzymes | |
|---|---|
| Protease | EC 3.4.4.16* |
| Protease | EC 3.4.24.4 |
| Pronase | enzyme mixture of *Streptomyces griseus* |
| Proteinase | EC 3.4.21.13 |
| Trypsin | EC 3.4.21.4 |
| Pepsin | EC 3.4.23.1 |

*EC = enzyme commission

TABLE 2

| Analytical values | | Tobacco mixture to be prepared (American Blend), as used in Ex. 1 | Tobacco prepared according to Ex. 1 |
|---|---|---|---|
| (a) Tobacco analysis | | | |
| Total alkaloids %* | | 1.96 | 1.76 |
| Reducing substances % | | 6.7 | 3.9 |
| Nitrate N % | | 0.25 | 0.03 |
| Ammonia N % | | 0.31 | 0.05 |
| Total N % | | 3.22 | 1.63 |
| (b) Analysis of mainstream smoke: | | | |
| CO | mg/cig** | 16.1 | 9.1 |
| NO | mg/cig | 0.31 | 0.03 |
| TPM | mg/cig | 19.1 | 12.5 |
| Nicotine | mg/cig | 1.31 | 1.05 |
| HCN | mg/cig | 0.243 | 0.030 |
| Aldehyde | mg/cig | 1.41 | 1.29 |

*% = dry weight percent
**mg/cig = milligram per cigarette

TABLE 3

| Analytical values | Tobacco mixture to be prepared (American Blend) as used in Ex. 1 | Pretreated tobacco, i.e. pressed-out strips. | Aqueous solution |
|---|---|---|---|
| Total N %* | 2.95 | 0.99 | 0.139 |
| Ammonia N % | 0.22 | 0.02 | 0.012 |
| Nitrate N % | 0.22 | 0.02 | 0.017 |
| Alkaloid N % | 0.33 | 0.03 | 0.025 |
| Protein N % | 2.18 | 0.92 | 0.085 |
| Protein % | 13.62 | 5.70 | 0.53 |
| Dissolved substance total % | — | — | 1.61 |

*% = dry weight percent

TABLE 4

| Example | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|
| (a) Extraction of proteins from tobacco | | | | | | | | | | | | | | | | | | | | | | |
| Strips:water | 1:15 | 1:10 | 1:5 | 1:20 | 1:15 | 1:15 | 1:15 | 1:15 | 1:15 | 1:15 | 1:15 | 1:15 | 1:15 | 1:15 | 1:15 | 1:15 | 1:15 | 1:15 | 1:15 | 1:15 | 1:15 | 1:15 |
| Temperature (°C.) | 37 | 37 | 37 | 37 | 50 | 65 | 30 | 37 | 37 | 37 | 37 | 37 | 37 | 37 | 37 | 37 | 37 | 37 | 37 | 37 | 37 | 37 |
| pH | 7.5 | 7.5 | 7.5 | 7.5 | 7.5 | 7.5 | 7.5 | 7.0 | 8.0 | 1.5 | 4 | 7.5 | 7.5 | 7.5 | 7.5 | 7.5 | 7.5 | 7.5 | 7.5 | 7.5 | 7.5 | 7.5 |
| Time (hours) | 6 | 6 | 6 | 6 | 6 | 6 | 6 | 6 | 6 | 6 | 6 | 10 | 2 | 2 | 6 | 6 | 6 | 6 | 6 | 6 | 6 | 6 |
| Enzyme quantity (g/kg tobacco) | 3.75 | 3.75 | 3.75 | 3.75 | 3.75 | 3.75 | 3.75 | 3.75 | 3.75 | 3.75 | 3.75 | 3.75 | 3.75 | 10 | 1 | 7.5 | 3.75 | 3.75 | 3.75 | 3.75 | 3.75 | 3.75 |
| Enzyme activity (unit/mg enzyme) | 1 | 1 | 1 | 1 | 1 | 1 | 1 | 1 | 1 | 1 | 1 | 1 | 1 | 1 | 3.75 | 0.5 | 1 | 1 | 1 | 1 | 1 | 1 |
| Enzyme used | EC 3.4.24.4 | | | | | | EC 3.4.24.4 | | | EC 3.4.24.1 | | | EC 2.4.24.4 | | | EC 3.4.24.4 | | | | | EC 3.4.24.4 | |
| (b) Untreated solution | | | | | | | | | | | | | | | | | | | | | | |
| Nitrate N %* | 0.017 | 0.025 | 0.039 | 0.013 | 0.017 | 0.017 | 0.017 | 0.017 | 0.017 | 0.015 | 0.015 | 0.017 | 0.017 | 0.017 | 0.017 | 0.017 | 0.017 | 0.017 | 0.017 | 0.017 | 0.017 | 0.017 |
| Ammonium N % | 0.012 | 0.020 | 0.031 | 0.01 | 0.012 | 0.012 | 0.012 | 0.012 | 0.012 | 0.010 | 0.01 | 0.012 | 0.012 | 0.012 | 0.012 | 0.012 | 0.012 | 0.012 | 0.012 | 0.012 | 0.012 | 0.012 |
| Protein N % | 0.085 | 0.120 | 0.204 | 0.066 | 0.90 | 0.08 | 0.08 | 0.08 | 0.08 | 0.07 | 0.09 | 0.09 | 0.06 | 0.095 | 0.085 | 0.085 | 0.085 | 0.085 | 0.085 | 0.085 | 0.085 | 0.085 |
| (c) Addition and fermentation conditions | | | | | | | | | | | | | | | | | | | | | | |
| Glucose % | 4.2 | 6.9 | 11.4 | 3.3 | 4.4 | 4.0 | 4.0 | 4.0 | 4.0 | 3.5 | 4.2 | 4.4 | 3.3 | 4.6 | 4.2 | 4.2 | 4.2 | 4.2 | 4.2 | 4.2 | 4.2 | 4.2 |
| Temperature (°C.) % | 30 | 30 | 30 | 30 | 30 | 30 | 30 | 30 | 30 | 30 | 30 | 30 | 30 | 30 | 30 | 30 | 25 | 36 | 30 | 30 | 30 | 30 |
| pH | 5.5 | 5.5 | 5.5 | 5.5 | 5.5 | 5.5 | 5.5 | 5.5 | 5.5 | 5.5 | 5.5 | 5.5 | 5.5 | 5.5 | 5.5 | 5.5 | 5.5 | 5.5 | 4.0 | 6.0 | 5.5 | 5.5 |
| Potassium hydrogen phosphate ($KH_2PO_4$) | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.5 | 1.0 |
| (d) Treated solution | | | | | | | | | | | | | | | | | | | | | | |
| Nitrate N % | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| Ammonium N % | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| Protein N % | 0.005 | 0.007 | 0.05 | 0.003 | 0.004 | 0.003 | 0.003 | 0.003 | 0.003 | 0 | 0.004 | 0.003 | 0 | 0.006 | 0.005 | 0.005 | 0.005 | 0.005 | 0.005 | 0.005 | 0.005 | 0.005 |
| Glucose % | 0 | | | | | 0 | 0 | 0 | 0 | 0 | 0 | 0 | 0 | 0 | 0 | 0 | 0 | 0 | 0 | 0 | 0 | 0 |
| Potassium hydrogen phosphate ($KH_2PO_4$) | 0 | 0 | 0 | 0 | 0 | 0 | 0 | 0 | 0 | 0 | 0 | 0 | 0 | 0 | 0 | 0 | 0 | 0 | 0 | 0 | 0.2 | 0.6 |

*% = dry weight percent

TABLE 5

| Selection of suitable microorganisms having the capacity to assimilate proteins and protein subnits | |
|---|---|
| *Candida utilis* | DSM 70167 |
| *Candida utilis* | NCYC 707 = CBS 359 |
| *Candida utilis* | CBS 621 |
| *Candida utilis* | NCYC 321 |
| *Candida berthetii* | CBS 5452 |

These strains are permanently available as standard strains at public filing stations, i.e.

DSM = Deutsche Sammlung von Mikroorganismen Grisebachstrasse 8 D-3400 Gottingen

NCYC = NATIONAL COLLECTION OF YEAST CULTURES Lyttel Hall, Surrey RH 1 4 HY Nutfield Ridge 2272, Great Britain CBS = Centraalbureau voor Schimmelcultures Julianalaan 67 a Delft/Netherlands

We claim:

1. Process for the treatment of tobacco comprising the steps of:

(a) subjecting cured tobacco to aqueous enzyme treatment whereby insoluble protein components are decomposed into soluble fragments, (b) separating the resulting solution from the tobacco residue, and (c) subjecting the separated solution to microorganisms capable of metabolically assimilating the soluble protein fragments therein, thereby generating a biomass.

2. The process of claim 1 including the further steps of:

(d) removing said biomass from the solution, and (e) applying the thus-treated solution to tobacco which has been treated as in steps (a) and (b).

3. Process according to claim 2, wherein step (a) is applied to a suspension of comminuted tobacco in water in a weight ratio of 1:3 to 1:12.

4. Process according to claim 3, wherein the weight ratio is 1:5.

5. Process according to claim 3, wherein the aqueous enzyme treatment is performed at 30° to 70° C. with an enzyme concentration selected at such a level that insoluble protein substances are reduced to 20 to 40% of the initial value before the enzyme has lost 90% of its original activity.

6. Process according to one of the claims 1–5 wherein following step (b) the solution is sterilized, then inoculated with a culture of microorganisms having the capacity to assimilate proteins and protein subunits, said culture having been brought into its exponential growth phase, and the inoculated solution, with addition of sugar, kept under favorable living conditions for said culture until the dissolved protein fragments and other low molecular weight nitrogen compounds have been at least 95% consumed.

7. Process according to any of claims 2–5 wherein the separated biomass from step (d) is (1) subjected to destructive protein hydrolysis in such a way that those amino acids which, with reducing sugars and heating, are not converted by the Maillard reaction into amadori compounds which liberate tobacco aromas on thermal decomposition are selectively destroyed, and (2) treated with reducing sugar and heat so as to form amadori compounds from the remaining amino acids, which amadori compounds are then combined with the solution of step (e) before its application to tobacco.

* * * * *

UNITED STATES PATENT AND TRADEMARK OFFICE

CERTIFICATE OF CORRECTION

PATENT NO. : 4,407,307

DATED : October 4, 1983

INVENTOR(S) : Helmut Gaisch et al

It is certified that error appears in the above-identified patent and that said Letters Patent is hereby corrected as shown below:

Column 1, line 22, change "problem" to --object--.

Column 2, line 3, change "by trial and error" to empirically--.

Column 2, line 15, change "with" to --in--.

Column 2, line 19, change "9/10" to --90%--.

Column 2, line 31, change "by trial and error" to --empirically--.

Column 2, line 43, change "inocculated" to --inoculated--.

Column 2, lines 66-67, change "The contents could be topped up" to --The tobacco may be enhanced--.

Column 3, lines 12-13, delete "are converted with reducing sugar into amador compounds".

Column 3, line 13, change "amador" to --amadori--.

Column 3, line 14, insert --are converted with reducing sugar into amadori compounds-- after "valine".

Column 3, line 23, change "solution" to --soluble--.

Column 3, line 54, change "hydrolyzed by casein" to --required to hydrolyze casein--.

Column 3, lines 64-65, delete "with the solution,".

Column 4, line 17, change "20" (2nd occurrence) to --30--.

UNITED STATES PATENT AND TRADEMARK OFFICE

CERTIFICATE OF CORRECTION

PATENT NO. : 4,407,307

DATED : October 4, 1983

INVENTOR(S) : Helmut Gaisch et al

It is certified that error appears in the above-identified patent and that said Letters Patent is hereby corrected as shown below:

Column 5, line 29, change "EC 3.4.21.13" to --EC 3.4.21.14--.

Column 7, Table 4, Examples 11-12, on line Enzyme used, change "EC 3.4.24.1" to --EC 3.4.23.1--.

Column 7, Table 4, Examples 14-15, on line Enzyme used, change "EC 2.4.24.4" to --EC 3.4.24.4--.

Column 9, line 9, change "filing stations" to --depositories--.

Claim 1, line 1, change "Process" --A process--.

Claim 2, line 1, change "of" to --according to--.

Claims 3-7, line 1 of each, change "Process" to --The process--.

Claim 6, line 1, delete "the", first occurrence.

Claim 7, line 1, change "claims" to --Claims--.

Signed and Sealed this

*Nineteenth* Day of *February 1985*

[SEAL]

*Attest:*

DONALD J. QUIGG

*Attesting Officer*

*Acting Commissioner of Patents and Trademarks*